US008881649B2

(12) United States Patent
De Gaillande

(10) Patent No.: US 8,881,649 B2
(45) Date of Patent: Nov. 11, 2014

(54) PRINTING DEVICE USING STAMPING

(75) Inventor: Christophe De Gaillande, Bussigny (CH)

(73) Assignee: Bobst Mex SA (CH)

( * ) Notice: Subject to any disclaimer, the term of this patent is extended or adjusted under 35 U.S.C. 154(b) by 42 days.

(21) Appl. No.: 13/821,278

(22) PCT Filed: Aug. 30, 2011

(86) PCT No.: PCT/EP2011/004344

§ 371 (c)(1), (2), (4) Date: Mar. 7, 2013

(87) PCT Pub. No.: WO2012/034645

PCT Pub. Date: Mar. 22, 2012

(65) Prior Publication Data

US 2013/0160663 A1 Jun. 27, 2013

(30) Foreign Application Priority Data

Sep. 16, 2010 (EP) ..... 10009662

(51) Int. Cl.

| | |
|---|---|
| ***B41F 19/02*** | (2006.01) |
| ***B41D 7/00*** | (2006.01) |
| ***B41F 16/00*** | (2006.01) |
| ***B41F 1/32*** | (2006.01) |
| ***B65H 29/56*** | (2006.01) |
| ***B41F 1/38*** | (2006.01) |
| ***B65H 29/04*** | (2006.01) |
| ***B41F 1/44*** | (2006.01) |
| ***B41F 1/30*** | (2006.01) |
| ***B41F 1/12*** | (2006.01) |

(52) U.S. Cl.

CPC ..... *B41F 16/0093* (2013.01); *B41F 1/32* (2013.01); *B65H 29/56* (2013.01); *B41F 1/38* (2013.01); *B65H 29/044* (2013.01); *B41F 1/44* (2013.01); *B41F 1/30* (2013.01); *B41F 1/12* (2013.01); *B65H 2406/122* (2013.01)

USPC ..... 101/27; 101/33

(58) Field of Classification Search

USPC ..... 101/21, 27, 33, 34; 156/529, 542; 100/90, 118, 311

See application file for complete search history.

(56) References Cited

U.S. PATENT DOCUMENTS 3,506,259 A * 4/1970 Caldwell et al. ..... 271/276
4,059,470 A 11/1977 Primavesi et al.

(Continued)

FOREIGN PATENT DOCUMENTS

| | | |
|---|---|---|
| CH | 457 207 | 5/1968 |
| EP | 0 739 722 A1 | 10/1996 |
| EP | 1 468 828 A2 | 10/2004 |

OTHER PUBLICATIONS

International Search Report dated Oct. 28, 2011 issued in corresponding international patent application No. PCT/EP2011/004344.

*Primary Examiner* — Ren Yan
(74) *Attorney, Agent, or Firm* — Ostrolenk Faber LLP

(57) ABSTRACT

A printing device for printing elements in sheet fond: a platen press 310 for depositing onto each sheet 10, by stamping, colored or metalized film from at least one stamping foil; a conveyor using a succession of gripper bars for moving each sheet 10 individually through the platen press 310; a blower member separates each stamping foil from each sheet as it leaves the platen press, the blower member being movable between a work position, in which it is able to operate from the transfer region in which the gripper bars 610 run to the exit of the platen press 310, and a withdrawn position, in which it keeps away from said transfer region.

15 Claims, 6 Drawing Sheets

(56) References Cited

U.S. PATENT DOCUMENTS 5,840,155 A * 11/1998 Rebeaud ..... 156/757
8,661,975 B2 * 3/2014 Feyerabend et al. ..... 101/232
2004/0206254 A1 * 10/2004 Both et al. ..... 101/27
2012/0247352 A1 * 10/2012 Fornay ..... 101/27

* cited by examiner

PRINTING DEVICE USING STAMPING

CROSS-REFERENCE TO RELATED APPLICATIONS

The present application is a 35 U.S.C. §§371 national phase conversion of PCT/EP2011, filed Aug. 30, 2011, which claims priority of European Application No. 10009662.7, filed Sep. 16, 2010, the contents of which are incorporated by reference herein. The PCT International Application was published in the French language.

BACKGROUND OF THE INVENTION

The present invention relates to a device that allows elements in sheet form to be printed using stamping.

The invention finds a particularly advantageous, although non-exclusive, application in the field of the manufacture of packaging intended for the luxury-goods industry.

It is known practice for texts and/or patterns to be printed by stamping, that is to say by using pressure to apply to a medium in sheet form, colored or metalized film taken from one or more stamping foils commonly known as metalized foils. In the industry, such a transfer operation is usually performed using a vertical platen press into which the press supports are introduced, sheet by sheet, while the stamping foils are fed continuously.

In a standard platen press, stamping is conventionally performed between a fixed platen extending horizontally, and a platen mounted so that it can move in a reciprocating vertical movement. Because this type of press is generally automated, conveyor means are provided to bring each sheet between the platens one by one. In practice, this means is usually a series of gripper bars, each of which in turn grasps a sheet at its frontal edge, before pulling it between the two platens when the latter have been parted sufficiently.

A stamping foil is itself schematically made up of a backing strip of polyester type, to which a pigmented layer is secured by a layer of wax. The external face of this pigmented layer is itself coated with a coat of hot-melt adhesive. As in the case of the sheets, the feed of stamping foils to the press is conventionally automated, by means of a drive system capable of unwinding each of said foils and feeding it in a clearly determined feed path which notably passes through the platen press. In general, such a foil feed system combines a series of diverting bars which are installed along the entire feed path to guide the progress of the foils, with a number of advance shafts which are positioned downstream of said path in order respectively to drive the movement of each of said foils.

In each machine cycle, a sheet is brought between the two platens, while the stamping foils are moved on and then likewise immobilized at the same point. The platen press is then closed. This closure presses the sheet and the foils between a plurality of forms and of matrices positioned facing one another on each of the platens respectively. Because the forms or the matrices are heated, the wax therefore melts and the hot-melt adhesive sets only at their regions of contact, thus transferring the pigments from the foils to the sheet in a given pattern.

In practice though, it is unfortunately found that, when the platen press is reopened after stamping, the various polyester backing strips have a natural tendency to remain stuck to the sheet.

In order to overcome this difficulty, it is known practice for separation between the stamping foils and the sheet to be forced by aiming a pressurized jet of air at where they are stuck. To do that, use is generally made of a blower which is fixed directly to the exit of the platen press, and which uses blowing nozzles positioned as close as possible to the plane in which the sheets move, that is to say directly in the gripper bar transfer region.

Such an arrangement does, however, have the disadvantage of entailing the use of gripper bars fitted with grippers at the top, that is to say with grippers which are configured to grasp each sheet substantially at the top face of the gripper bar. Now, it is known that this type of gripper is unable to guarantee optimal transport of the sheets through the platen press. The special form of the top grippers in fact causes each sheet to be moved some distance from the moving lower platen, that is to say without being supported so that it remains substantially horizontal. As it slows down, the sheet will therefore have a natural tendency to deform, thereby causing rumpling which is particularly detrimental to print quality.

SUMMARY OF THE INVENTION

Hence, the technical problem that the subject of the present invention attempts to solve is that of proposing a printing device for printing elements in sheet form, comprising a platen press for depositing onto each sheet, by stamping, colored or metalized film from at least one stamping foil, conveyor means using a succession of gripper bars for moving each sheet individually through the platen press, and a blower member for separating each stamping foil from each sheet leaving the platen press, which printing device would make it possible to avoid the problems of the prior art by offering both optimum conveying of the sheets through the platen press and perfect detachment of the foils after stamping.

The solution to the stated technical problem according to the present invention comprises the blower member being mounted with the ability to move between a work position, in which it is able to operate from the transfer region in which the gripper bars run to the exit of the platen press, and a withdrawn position, in which it keeps away from said transfer region.

It should be noted that the work position here constitutes an optimum operating position, without this necessarily being the only position in which the blower member is capable of operating. In other words, that means that, within the scope of the invention, it is entirely conceivable for the blower member to be operated in other positions, notably positions comprised between the work position in question and the withdrawn position.

It should also be understood that the withdrawn position for its part denotes any positioning of the blower member which allows the gripper bars freedom to move at the exit of the platen press. While in theory the locations corresponding to such a criterion might appear numerous, in practice, the withdrawn position will advantageously be established on the basis of the space available within the stamping machine, and the dynamics chosen for moving the blower means.

In any event, the invention as thus defined has the advantage of being compatible with the use of gripper bars provided with grippers at the bottom, that is to say with grippers which are configured to grasp each sheet substantially at the lower face of the gripper bar. Now, it is known that this type of gripper is extremely well suited to conveying sheets through the platen press. The special shape of the bottom grippers indeed allows each sheet to be made to undergo a translational movement as close as possible to the moving lower platen. The latter can then advantageously act as a support, supporting the sheet substantially horizontally throughout its movement. It thus becomes possible to avoid any risk of rumpling, and obtain accurate positioning of the sheet despite the significant deceleration it will undergo just before it reaches a standstill between the platens of the press. Ultimately, this will allow a significant improvement in print quality, but will also allow an increase in the throughput of the printing device.

The present invention also relates to the features that will become apparent during the course of the description which follows, and which should be considered in isolation or in any technically feasible combination.

This description, which is given by way of nonlimiting example, is intended to provide a better understanding of the substance of the invention and of how it may be embodied. The description is also given with reference to the attached drawings, in which:

BRIEF DESCRIPTION OF THE DRAWINGS

FIG. 5 shows a first phase of operation during which stamping takes place.

FIG. 6 reveals a second operating phase which corresponds to the opening of the platen press.

FIG. 7 depicts a third operating phase a specific feature of which is that the platen press is wide open.

FIG. 8 illustrates a fourth operating phase which is notably characterized by the departure of the gripper bar.

FIG. 9 shows a fifth operating phase corresponding to the arrival of a new gripper bar within the platen press.

FIG. 10 reveals a sixth operating phase during which the new gripper bar in turn leaves the platen press.

DESCRIPTION OF AN EMBODIMENT

For the sake of clarity, the same elements have been denoted by identical references. Likewise, only elements essential for understanding the invention have been depicted, and then only schematically and not to scale.

Figure 1:
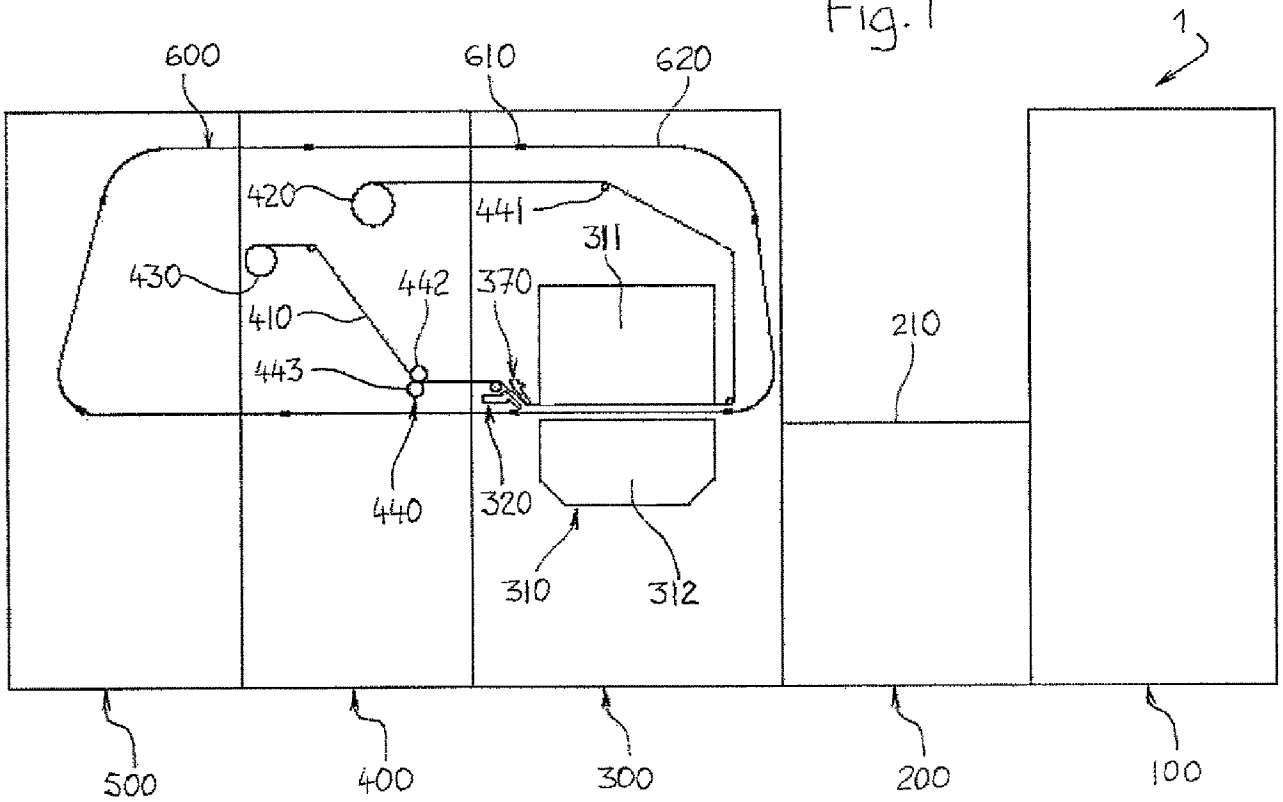
FIG. 1 illustrates a gilding machine into which a printing device according to the invention is incorporated.

FIG. 1 depicts a stamping machine 1 which is intended for customizing cardboard packaging for the luxury goods industry. Commonly known as a gilding machine, this stamping machine 1 is conventionally made up of a number of work stations 100, 200, 300, 400, 500 which are juxtaposed with, but interdependent on, one another in order to form a unit assembly capable of processing a series of supports 10, 20 in sheet form. There is thus a feeder 100, a feed table 200, a printing device 300, a foil feed and recovery station 400, and a delivery station 500. Conveyor means 600 are also provided to move each sheet 10, 20 along individually from the exit of the feed table 200 to the delivery station 500, including through the printing device 300.

The various parts 100, 200, 300, 400, 500, 600 of the printing machine 1 are perfectly known from the prior art and will therefore not be described in detail here, either in terms of their structure or in terms of their operation.

It will simply be specified that, in this particular embodiment, chosen solely by way of example, the feeder 100 is fed via a succession of pallets on each of which a plurality of sheets of cardboard 10, 20 are stacked. These sheets are successively taken off the top of the stack by a suction-type gripper member which transports them as far as the directly adjacent feed table 200.

At the feed table 200, the sheets 10, 20 are laid out in a layer by the suction-type gripper member, which means to say that they are laid one after the other with partial overlap. The whole layer is then driven along a platform 210 toward the printing device 300 by means of a belt-type mechanism. At the end of the layer, the lead sheet 10, 20 is systematically positioned accurately using front and side lays.

The work station situated just after the feed table 200 is therefore the printing device 300. The latter has the function of applying to each sheet 10, 20, by hot stamping, some metalized film which comes from a single stamping foil 410 in this embodiment. To do that, it uses a platen press 310 in which the stamping operation is performed in the conventional way, between a heated upper platen 311 which is fixed, and a lower platen 312 which is mounted with the ability to effect a reciprocating vertical movement.

Downstream of the printing device 300 is the foil feed and recovery station 400. As its name suggests, this station plays a dual role because it has the task both of feeding the machine with stamping foil 410, and of removing this same foil once it is spent.

In this particular embodiment, the foil 410 is stored in the conventional way in wound form, around a feed reel 420 mounted such that it can rotate. Likewise, having passed through the platen press 310, the foil 410 is wound around a take-up reel 430, mounted such that it can rotate.

Between its storage point and its take-up point, the foil 410 is driven along by a drive system 440 which is capable of progressing it over a given distance and along a determined feed path which notably passes through the platen press 310. This foil drive system 440 is chiefly made up, on the one hand, of a series of diverting bars 441, which are installed along the feed path to guide the movement of the foil 410, and on the other hand, of a combination of an advance shaft 442 and of a press roller 443 which are positioned downstream of said feed path in order to drive said foil 410 along.

The process of processing the sheets in the printing machine 1 ends at the delivery station 500, the main function of which is to form the already processed sheets 10, 20 back into a stack. To do that, the conveyor means 600 are arranged to release each sheet 10, 20 automatically when this sheet comes back into line with this new stack. The sheet 10, 20 then drops squarely onto the top of the stack.

In a highly conventional way, the conveyor means 600 use a series of gripper bars 610 which are mounted with transverse translational mobility via two chain sets 620 arranged laterally along each side of the stamping machine 1. Each chain set 620 travels in a loop which allows the gripper bars 610 to follow a trajectory that passes in succession through the printing device 300, the feed and discharge station 400 and the delivery station 500.

FIG. 1 also shows that the printing device 300 has a blower member 320 which is capable of separating the stamping foil 410 from each sheet 10, 20 that has just undergone a stamping operation, by generating a flow of pressurized air where they are stuck together. According to the subject of the present invention, this blower member 320 is mounted with the ability to move between a work position and a withdrawn position. The assembly is arranged in such a way that, in the work position, the blower member 320 is able to operate from the transfer region in which the gripper bars 610 run directly to the exit of the platen press 310, and that in the withdrawn position, said blower member 320 is positioned away from said transfer region. It is important to note that, at this stage in the description, the mobility of the blower member 320 may, in theory, be any form of movement.

In this embodiment, the blower member 320 is schematically in the form of a hollow cross member 321 along which numerous blowing nozzles 322, installed transversely, are distributed. This cross member 321 is arranged parallel to the exit edge of the platen press 310 so that the blowing nozzles 322 are oriented in the direction of the exit from the platen press 310.

According to one currently preferred embodiment of the invention, between the work position and the withdrawn position, the blower member 320 is mounted with translational mobility in a planar trajectory that is substantially orthogonal to the plane of transfer in which the sheets 10, run inside the platen press 310. It must be understood this time that the planar trajectory in question may in theory be any, that is to say be purely rectilinear or circular, more generally be curvilinear, or may result from any combination of these movements whatsoever.

For preference, however, the translational mobility of the blower member 320 here is in a direction which in general is substantially oblique to the plane of transfer in which the sheets 10, 20 run inside the platen press 310. The assembly is also arranged in such a way that the oblique direction in question is oriented in such a way that it converges toward the platen press 310 as it nears the plane of transfer of the sheets 10, 20. This feature means that there is more time available for the translational movement of the blower member 320, thus offering the option of best optimizing the timing of the movements of the various moving parts present in the region of the exit of the platen press 310.

In a particularly advantageous way, the printing device 300 is provided with first guide means 330 able to guide the movement of the blower member 320 between the work position and the withdrawn position.

In this embodiment, the blower member 320 is supported directly by the first guide means 330, by means of two structurally identical lateral mechanisms 331 which are positioned symmetrically on each side of the printing device 300 and which are respectively connected to each of the ends of the hollow cross member 321.

Figure 2:
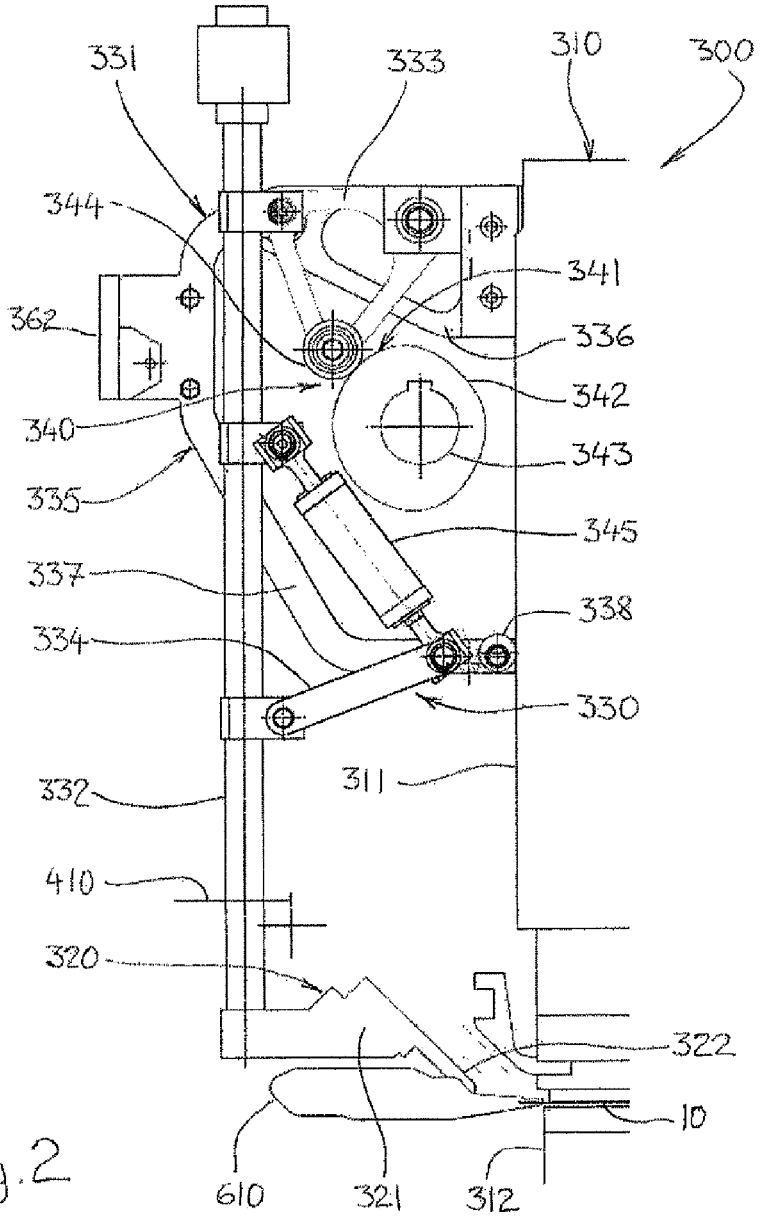
FIG. 2 shows in detail how the blower member is incorporated into the printing device.

As may be seen from FIG. 2, each mechanism 331 comprises a control bar 332, the lower end of which is secured to the blower member 320. This control bar 332 is connected via two pivoting levers 333, 334 to a support 335 which is secured to the fixed upper platen 311 of the press 310 and which is made up of a fixing piece 336 and of a yoke 337. The assembly is arranged in such a way that the control bar 332, the two pivoting levers 333, 334 and the support 335 define a deformable quadrilateral. FIG. 2 clearly shows that the upper lever 333 is shorter than the lower lever 334, which means that the deformable quadrilateral is here more likened to a trapezium the deformation of which will advantageously generate a sweeping effect, that is to say cause the blower member 320 to move in a substantially oblique and curvilinear translational movement.

According to another advantageous feature of the invention, the printing device 300 is also provided with first drive means 340 able to move the blower member 320 between the work position and the withdrawn position.

In this embodiment, the first drive means 340 cause the blower member 320 to move by directly actuating the first guide means 330. They are therefore suited to the fact that guidance is performed at each end of the blower member 320, and this is why, according to FIG. 2, a lateral drive mechanism 341 is associated with each lateral guide mechanism 331.

Hence then, in each lateral drive mechanism 341, the first drive means 340 comprise a cam 342 secured to a transmission shaft 343 able to be rotationally driven by an electric motor (not depicted), the operation of which is synchronized with the operating cycle of the platen press 310. The cam 342 collaborates in drive with a roller or follower 344 which is mounted to rotate on the short lever 333. An elastic return means 345 is provided to guarantee contact between the follower 344 and the cam 342. In this particular instance this is a tension spring which is positioned between an upper anchor point situated on the control bar 332 and a lower anchor point positioned on the yoke 337.

The assembly is arranged in such a way that the elastic return means 345 constantly pulls the control bar 332 downward, and this causes the follower 344 to press against the cam 342. Hence then, when the transmission shaft 343 turns, the rotation of the cam 342 causes the short lever 333 to pivot in one direction or the other, thus causing the control bar 332 to move up or down and as a consequence causing the blower member 320 to rise or fall.

Figure 3:
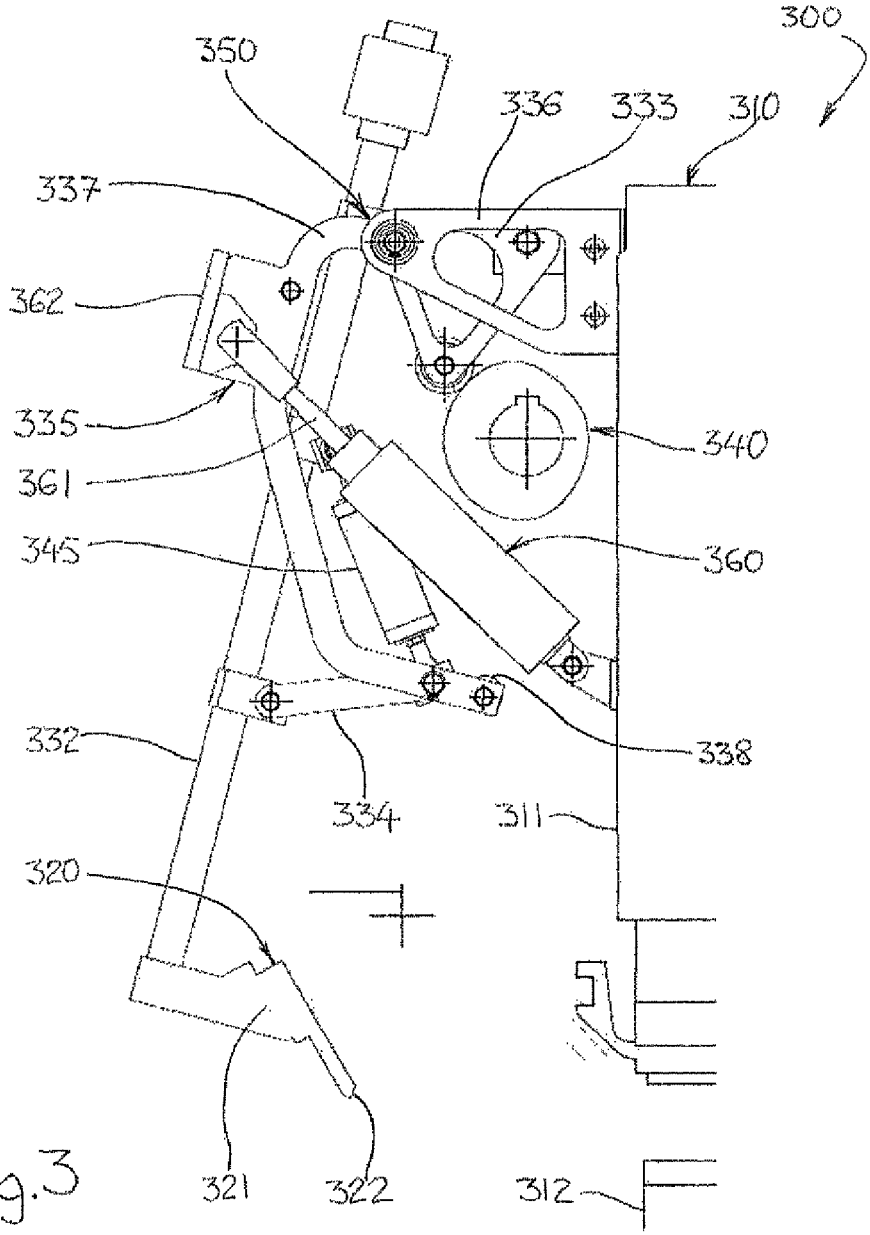
FIG. 3 is similar to FIG. 2, but with the blower member positioned in a position known as the clear position.

According to one particular feature of the invention which can be seen in FIG. 3, the blower member 320 is also able to be moved into a clear position in which it keeps some distance away from the exit from the platen press 310. It is important to emphasize that, in theory, the clear position can be accessible with no implied preference either from the work position and/or from the withdrawn position.

In a particularly advantageous way, the printing device 300 is provided with second guide means 350 able to guide the movement of the blower member 320 into the clear position, namely between the work position and/or the withdrawn position on the one hand, and the clear position on the other.

As can be clearly seen from FIG. 3, at each support 335, the upper end of the yoke 337 is connected to the fixing piece 336 by a pivoting connection, while its lower end is not rigidly secured to the upper platen 311 of the press 310. In other words, that means that the support 335 is articulated, namely that the yoke 337 is able to pivot with respect to the fixing piece 336, and that the lower end of said yoke 337 is able to press against the upper platen 311, in this instance via an eccentric 338. It should be noted that the presence of this eccentric 338 allows the angular position of the yoke 337 to be adjusted with respect to the fixing piece 336 and therefore allows the position of the blower member 320 to be adjusted with respect to the exit from the platen press 310.

In any event, it was seen earlier that each control bar 332 is mounted to pivot at the end of the short lever 333 and that it is also connected to the support 335 by means of the long lever 334 and of the elastic return means 345 both of which employ pivoting connections. This means that the control bar 332 will be able to pivot with respect to the end of the short lever 333 as soon as the yoke 337 is made to pivot with respect to the fixing piece 336 (FIGS. 2 and 3). Following this line of logic, each control bar 332, each short lever 333, each long lever 334, each articulated support 335, and each elastic return means 345 have to be considered to be components of the second guide means 350, within the meaning of the invention.

According to another advantageous feature of the invention, the printing device 300 is also provided with second drive means 360 able to move the blower member 320 into the clear position.

As was the case with the first drive means 340, the second drive means 360 are arranged to cause the blower member 320 to move by directly actuating the second guide means 350.

In this exemplary embodiment, the second drive means 360 consist of a pneumatic actuator 361 the ends of which are respectively connected, via pivot connections, to the upper platen 311 of the press 310 on the one hand, and to a cross member 362 rigidly connecting the two yokes 337 on the other. Of course, any other known drive means could be used in an equivalent way. Thoughts here for example turn to a combination of a number of pneumatic actuators, to one or more hydraulic actuators or to a linear electric motor.

According to another feature of the invention, the printing device 300 further comprises a diverting member 370 able to guide the stamping foil 410 as it exits the platen press 310, and which is mounted with the ability to move between a close-up position and a remote position. The assembly is arranged in such a way that, in the close-up position, the diverting member 370 is able to operate at least partially in the transfer region in which the gripper bars 610 run at the exit of the platen press 310. The objective here is to keep the stamping foil 410 in a plane that allows it to run freely between the platens 311, 312 of the press 310. However, the assembly is also contrived in such a way that, in the remote position, the diverting member 370 can still play its part but keeping away from the region of transfer of the gripper bars 610. The objective here on the other hand is to leave each stamping foil 410 substantially in contact with one of the platens 311, 312 of the press 310, in this instance the fixed upper platen 311.

It is important to emphasize that, in the context of the invention, when a stamping foil is substantially in contact with a platen, that means, with no implied preference, that it is in the close proximity of or in actual contact with, or even pressed against, said platen. In any event, under these conditions that implies that it would not seem sensible to advance the stamping foil because the risk of damage would be far too great.

According to a currently preferred embodiment of the invention, between the close-up position and the remote position, the diverting member 370 is mounted with translational mobility in a planar trajectory which is substantially orthogonal to the transfer plane through which the sheets 10, 20 run inside the platen press. Once again it must be understood that the planar trajectory in question may, in theory, be any trajectory.

For preference, the translational mobility of the diverting member 370 is in a direction which is generally substantially oblique with respect to the transfer plane in which the sheets 10, 20 run inside the platen press 310. The assembly is also arranged in such a way that the oblique direction in question is oriented in such a way that it converges toward the platen press 310 as it nears the plane of transfer of the sheets 10, 20.

In a particularly advantageous way, the printing device 300 is provided with third guide means 380 able to guide the movement of the diverting member 370 between the close-up position and the remote position.

In this embodiment, the diverting member 370 is in the form of a cross member 371 which is arranged parallel to the exit edge from the platen press 310. This diverting member 370 is supported directly by the third guide means 380, in this case by means of two structurally identically lateral mechanisms 381 which are installed symmetrically on each side of the printing device 300 and which are respectively connected to each of the ends of the cross member 371.

Figure 4:
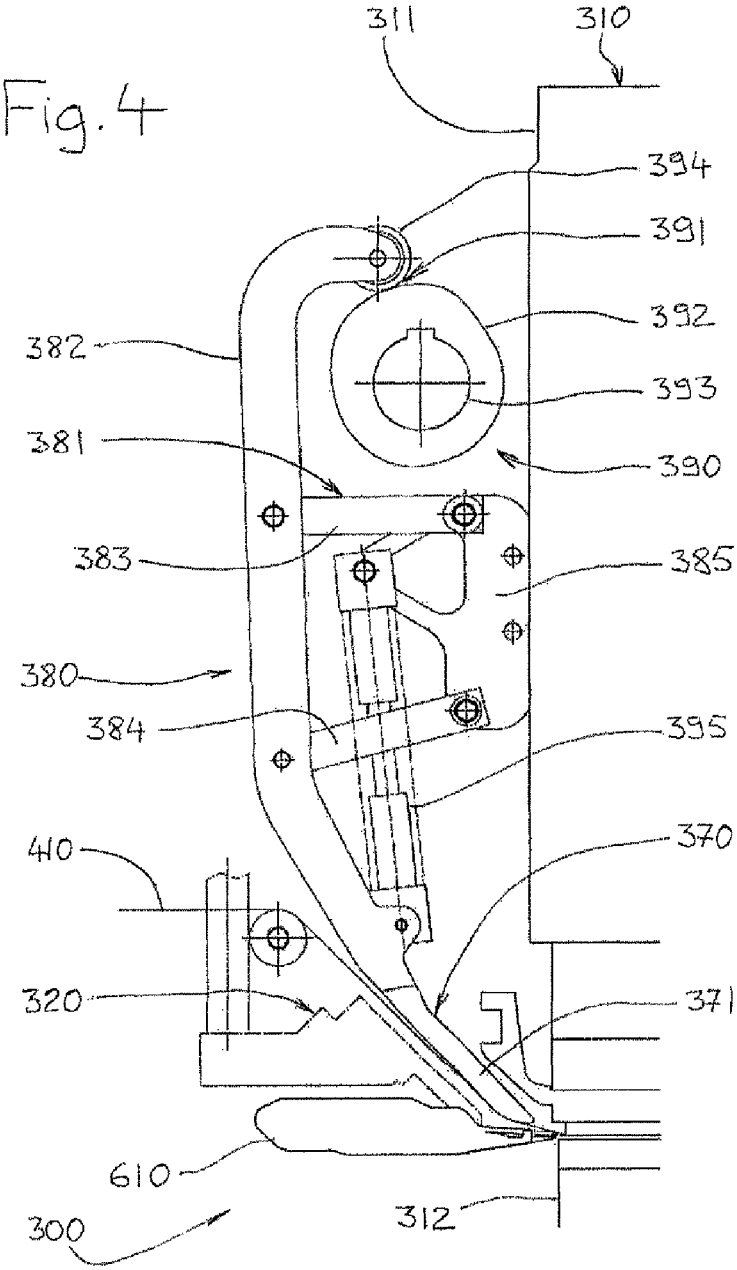
FIG. 4 shows in detail the incorporation of a diverting member with which the printing device is also provided.

As can be distinctly seen from FIG. 4, each lateral guide mechanism 381 comprises a control bar 382 to the lower end of which the diverting member 370 is fixed. This control bar 382 is connected by two pivoting levers 383, 384 to a support 385 which is secured to the fixed top plate 311 of the press 310. Once again, the assembly is arranged in such a way that the control bar 382, the two pivoting levers 383, 384 and the support 385 form a deformable quadrilateral. Further, since the upper lever 383 is once again shorter than the lower lever 384, the deformable quadrilateral in question can be more likened to a trapezium the deformation of which will naturally generate a sweeping effect, that is to say will cause the diverting member 370 to move in a substantially oblique and curvilinear translational movement.

According to another advantageous feature of the invention, the printing device 300 is moreover provided with third drive means 390 able to move the diverting member 370 between the close-up position and the remote position.

In this embodiment, the third drive means 390 cause the diverting member 370 to move by directly actuating the third guide means 380. They are therefore well suited to the fact that guidance is performed symmetrically at each end of the diverting member 370, and this is why, according to FIG. 4, a lateral drive mechanism 391 is associated with each lateral guide mechanism 381.

Thus then, at each lateral guide mechanism 391, the first drive means 390 comprise a cam 392 which is secured to a transmission shaft 393 able to be rotationally driven by an electric motor (not depicted) the operation of which is synchronized with the operating cycle of the platen press 310. The cam 392 collaborates in driving with a roller or follower 394 which is mounted to rotate at the upper end of the control bar 382. An elastic return means 395 is also provided to guarantee contact between the follower 394 and the cam 392. In this instance this is a compression spring which is positioned between an upper anchor point situated on the support 385 and a lower anchor point placed at the bottom part of the control bar 382.

The assembly is arranged in such a way that the elastic return means 385 constantly pushes the control bar 382 downward, causing the follower 394 to press against the cam 392. Thus then, as the transmission shaft 393 turns, the rotation of the cam 392 causes the control bar 382 to move up or down and therefore ultimately causes the diverting member 370 to rise or fall.

It may prove beneficial temporarily to halt the reciprocating movement of the diverting member 370, particularly when the printing device 300 is to be used to apply holograms to the sheets 10, 20. When this is the case, it is quite obviously essential for the diverting member 370 to be immobilized in a position that allows it not to encroach upon the transfer region of the gripper bars, that is to say in a position relatively close to the remote position. In any event, in the context of the invention, such temporary immobilization can be achieved advantageously by simply deactivating the third drive means 390, or by disengaging the third guide means 380 from said third drive means 390.

FIGS. 5 to 10 illustrate, in the region of the exit from the platen press 310, the main phases in the operating dynamics of the printing device 300 that forms the subject of the invention.

Figure 5:
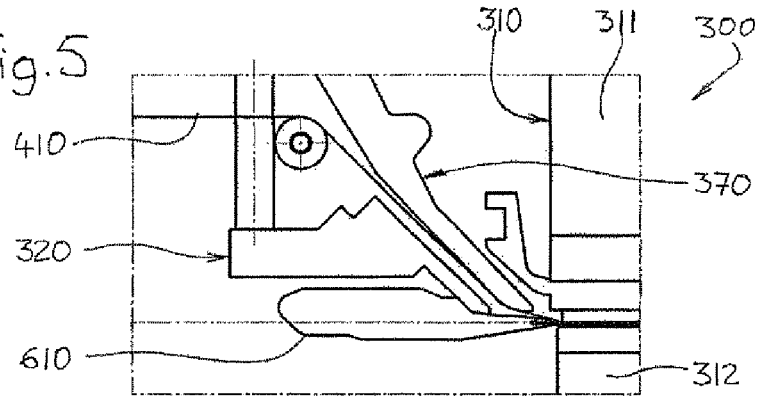
FIGS. 5 to 10 illustrate, at the exit from the platen press, the main phases in the operating dynamics of the printing device that forms the subject of the invention.

FIG. 5 shows that during the stamping operation, the platen press 310 is closed with the mobile lower platen 312 positioned entirely logically at its top dead center (tdc). The gripper bar 610 for its part is immobile at its tdc, while the blower member 320 is deactivated and at its tdc. The diverting member 370 for its part is simply at its tdc.

Figure 6:
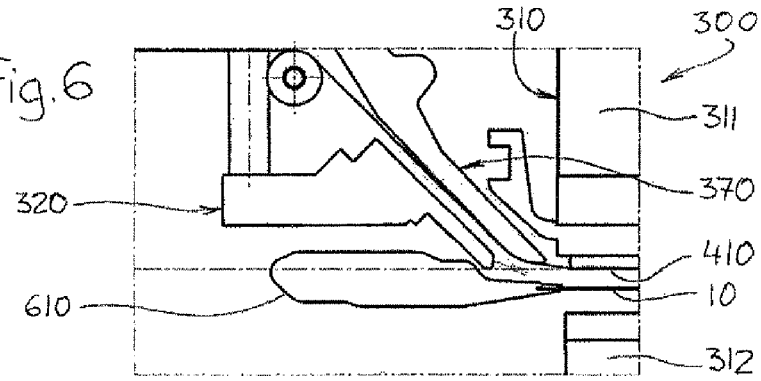

According to FIG. 6, the opening of the platen press 310 is embodied by the lowering of the moving platen 312, followed by that of the gripper bar 610. The blower member 320 is then activated and begins to fall in a manner that is synchronized with the gripper bar 610. The diverting member 370 likewise begins its own downward movement, but in a way that is offset in relation to the blower member 320, so as not to disturb the action of the latter.

Figure 7:
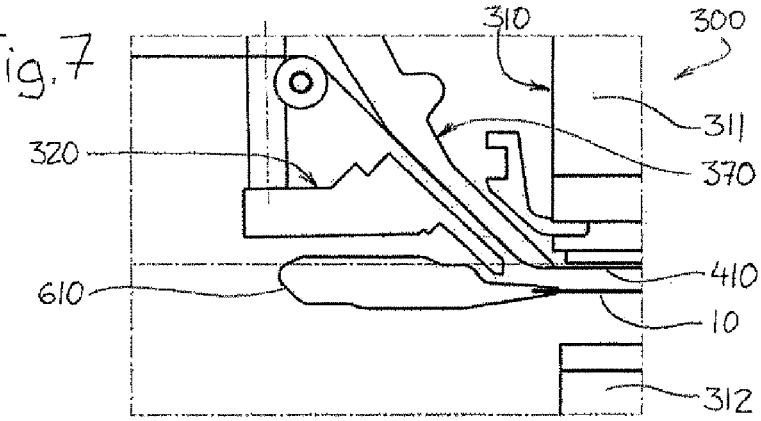

As may be seen in FIG. 7, when the platen press 310 is wide open, the moving lower platen 312 is at its bottom dead center (bdc). The same is true of the diverting member 370, and this means that the stamping foil 410 is then completely detached from the fixed upper platen 311 and can thus begin to advance. The blower member 320 has likewise reached its bdc, which means that the nozzles 322 at this moment are positioned between the body of the gripper bar 610 and the sheet 10. The blower member 320 can then be deactivated, and the gripper bar 610 can continue its downward movement.

Figure 8:
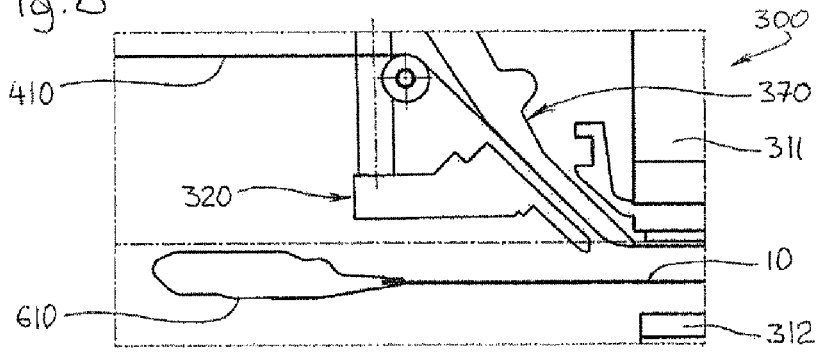

When the gripper bar 610 finally reaches its bdc, it can then be driven in a horizontal translational movement so as to extract the sheet 10 from the platen press 310 according to FIG. 8. Because the diverting member 370 is still at its bdc, the stamping foil 410 continues to advance. The blower member 320 for its part remains deactivated at its bdc.

Figure 9:
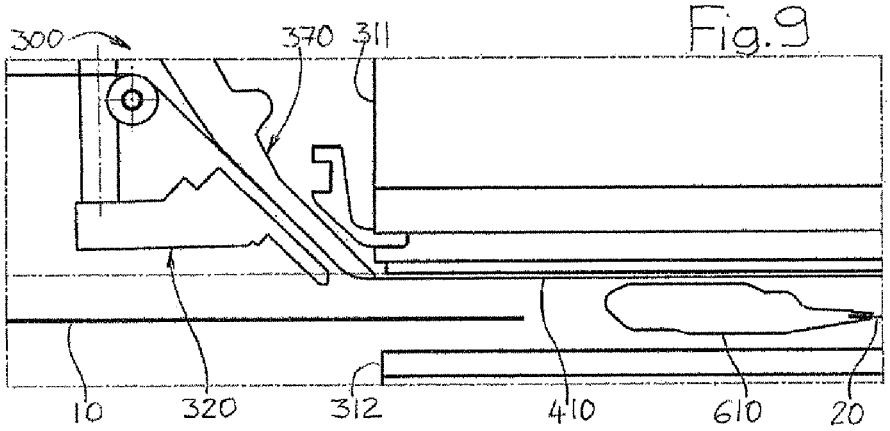

FIG. 9 illustrates the arrival of a new gripper bar 610 within the platen press 310 which is still wide open, while the blower member 320 and the diverting member 370 are still at their respective bdc positions.

Figure 10:
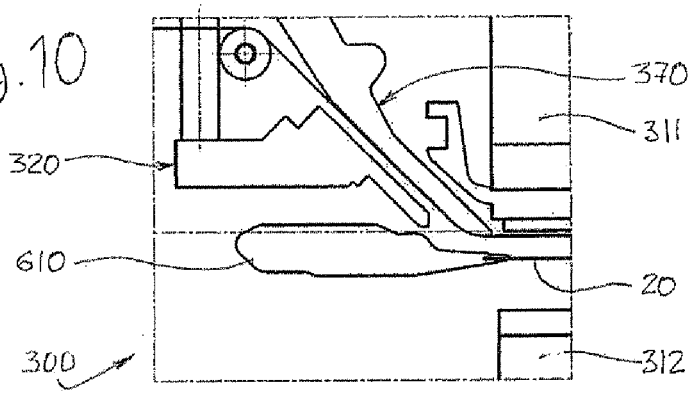

As can be seen in FIG. 10, as soon as the new gripper bar 610 has left the platen press 310, it begins its return upward movement concomitant with that of the moving lower platen 312. At the same time as that is going on, the blower member 320 and the diverting member 370 begin their own upward movements, while the stamping foil 410 ceases to advance. These various movements continue until the platen press 310 is completely closed, as shown in FIG. 5.

Of course, the invention relates more generally to any machine 1 for processing elements 10, 20 in sheet form which comprises at least one printing device 300 as previously described. Thoughts here turn especially to a gilding machine like the one used to illustrate the invention.

The invention claimed is:

1. A printing device for printing elements in sheet form, the device comprising:

a platen press configured for depositing onto each sheet by stamping, colored or metalized film from at least one stamping foil, the platen press having an exit;

a conveyor apparatus comprising a succession of gripper bars and located for moving each sheet individually through the platen press; and a blower member configured and located for separating each stamping foil from the sheet then leaving the platen press via the exit therefrom, the blower member is mounted in the printing device in a manner to have an ability to move between a work position, in which the blower member operates from a transfer region in which the gripper bars run to the exit of the platen press, and a withdrawn position, in which the blower member is away from the transfer region.

2. A printing device according to claim 1, wherein the blower member is mounted with translational mobility between the work position and the withdrawn position in a planar trajectory that is substantially orthogonal to a plane of transfer in which the sheets run inside the platen press.

3. A printing device according to claim 2, wherein between the work position and the withdrawn position, the blower member is mounted with translational mobility in a direction which in general is substantially oblique to the plane of transfer in which the sheets run inside the platen press and wherein the oblique direction converges toward the platen press as the oblique direction nears the transfer plane.

4. A printing device according to claim 1, further comprising a guide located and configured to guide movement of the blower member between the work position and the withdrawn position.

5. A printing device according to claim 1, further comprising a drive located and configured to move the blower member between the work position and the withdrawn position.

6. A printing device according to claim 1, wherein the blower member is movable into a clear position at a distance away from the exit from the platen press.

7. A printing device according to claim 6, further comprising a guide configured to guide the movement of the blower member into the clear position.

8. A printing device according to claim 6, further comprising a drive configured to move the blower member into the clear position.

9. A printing device according to claim 8, further comprising a guide located and configured to guide movement of the blower member between the work position and the withdrawn position.

10. A printing device according to claim 1, further comprising a diverting member located and configured to guide each stamping foil as it exits the platen press, said diverting member is mounted, located and configured to move between a close-up position, in which said diverting member operates at least partially in the transfer region in which said gripper bars run and also draw the sheets at the exit of the platen press, and a remote position in which the diverting member keeps away from the transfer region.

11. A printing device according to claim 10, wherein between the close-up position and the remote position, the diverting member is mounted with translational mobility in a planar trajectory which is substantially orthogonal to a transfer plane through which the sheets run inside the platen press.

12. A printing device according to claim 11, wherein between the close-up position and the remote position, the diverting member is mounted with translational mobility in a direction which is substantially oblique with respect to the transfer plane in which the sheets run inside the platen press, wherein said oblique direction converges toward said platen press as it nears said transfer plane.

13. A printing device according to claim 10, further comprising a guide located and configured to guide the movement of the diverting member between the close-up position and the remote position.

14. A printing device according to claim 10, further comprising a drive configured and located to move the diverting member between the close-up position and the remote position.

15. A machine for processing elements in sheet form, comprising at least one printing device according to claim 1.

* * * * *